US010350723B2

(12) United States Patent
Shen et al.

(10) Patent No.: US 10,350,723 B2
(45) Date of Patent: Jul. 16, 2019

(54) OVERPOLISHING BASED ON ELECTROMAGNETIC INDUCTIVE MONITORING OF TRENCH DEPTH

(71) Applicant: Applied Materials, Inc., Santa Clara, CA (US)

(72) Inventors: Shih-Haur Shen, Sunnyvale, CA (US); Jianshe Tang, San Jose, CA (US); Jimin Zhang, San Jose, CA (US); David Maxwell Gage, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 112 days.

(21) Appl. No.: 15/703,740

(22) Filed: Sep. 13, 2017

(65) Prior Publication Data

US 2018/0079048 A1 Mar. 22, 2018

Related U.S. Application Data

(60) Provisional application No. 62/464,269, filed on Feb. 27, 2017, provisional application No. 62/395,969, filed on Sep. 16, 2016.

(51) Int. Cl.
*B24B 37/013* (2012.01)
*B24B 37/10* (2012.01)
(Continued)

(52) U.S. Cl.
CPC ..... *B24B 37/013* (2013.01); *B24B 37/105* (2013.01); *B24B 37/205* (2013.01); *B24B 37/22* (2013.01); *B24B 49/12* (2013.01)

(58) Field of Classification Search
CPC ... B24B 37/013; B24B 37/105; B24B 37/205; B24B 49/12
(Continued)

(56) References Cited

U.S. PATENT DOCUMENTS 4,000,458 A 12/1976 Miller et al.
6,326,223 B1 12/2001 Miki
(Continued)

FOREIGN PATENT DOCUMENTS

JP 2008-286766 11/2008
TW 200505628 2/2005
(Continued)

OTHER PUBLICATIONS

Chen and Ker, "Investigation on seal-ring rules for IC product reliability in 0.25-μm CMOS technology," 2002, 45: 1311-1316.
(Continued)

*Primary Examiner* — George B Nguyen
(74) *Attorney, Agent, or Firm* — Fish & Richardson P.C.

(57) ABSTRACT

During polishing of a substrate a first signal is received from a first in-situ monitoring system and a second signal is received from a second in-situ monitoring system. A clearance time at which a conductive layer is cleared and a top surface of an underlying dielectric layer of the substrate exposed and determine based on the first signal. An initial value of the second signal at the determined clearance time is determined. An offset is added to the initial value to generate a threshold value, and a polishing endpoint is triggered when the second signal crosses the threshold value.

20 Claims, 4 Drawing Sheets

(51) Int. Cl.
*B24B 37/20* (2012.01)
*B24B 37/22* (2012.01)
*B24B 49/12* (2006.01)

(58) Field of Classification Search
USPC ..... 451/5
See application file for complete search history.

(56) References Cited

U.S. PATENT DOCUMENTS

| | | | | |
|---|---|---|---|---|
| 6,602,724 | B2 | 8/2003 | Redeker et al. | |
| 6,707,540 | B1 | 3/2004 | Lehman et al. | |
| 6,878,036 | B2 * | 4/2005 | Hanawa | B24B 37/013 451/288 |
| 7,042,558 | B1 * | 5/2006 | Sarfaty | G01B 7/105 324/244.1 |
| 7,078,894 | B2 * | 7/2006 | Tada | B24B 37/013 324/230 |
| 7,097,537 | B1 | 8/2006 | David | |
| 7,101,257 | B2 * | 9/2006 | Hirokawa | B24B 37/013 257/E21.23 |
| 7,112,960 | B2 * | 9/2006 | Miller | B24B 37/013 324/230 |
| 7,285,145 | B1 | 10/2007 | Zhu | |
| 8,334,582 | B2 | 12/2012 | Jeng et al. | |
| 8,587,061 | B2 | 11/2013 | Lee | |
| 8,628,376 | B2 | 1/2014 | Sin et al. | |
| 8,860,932 | B2 | 10/2014 | Zhang et al. | |
| 8,930,013 | B2 | 1/2015 | David et al. | |
| 9,233,450 | B2 | 1/2016 | David et al. | |
| 9,362,186 | B2 * | 6/2016 | Kitajima | H01L 22/26 |
| 9,437,507 | B2 * | 9/2016 | Nakamura | H01L 22/26 |
| 9,528,814 | B2 * | 12/2016 | Nikolenko | G01B 7/06 |
| 9,754,846 | B2 | 9/2017 | Lu et al. | |
| 9,811,077 | B2 * | 11/2017 | Kitajima | G05B 19/418 |
| 10,103,073 | B2 | 10/2018 | Lu et al. | |
| 2003/0201768 | A1 | 10/2003 | Le | |
| 2003/0223150 | A1 | 12/2003 | Lee | |
| 2004/0206621 | A1 | 10/2004 | Li | |
| 2005/0072528 | A1 | 4/2005 | Owczarz et al. | |
| 2006/0055007 | A1 | 3/2006 | Yao et al. | |
| 2008/0139087 | A1 | 6/2008 | Togawa | |
| 2008/0290865 | A1 | 11/2008 | Fujita | |
| 2009/0174011 | A1 | 7/2009 | Jeon et al. | |
| 2009/0286332 | A1 | 11/2009 | Ohta et al. | |
| 2010/0099334 | A1 | 4/2010 | Bennett | |
| 2010/0185314 | A1 | 7/2010 | Xu et al. | |
| 2011/0189856 | A1 | 8/2011 | Xu | |
| 2011/0189925 | A1 | 8/2011 | Iravani et al. | |
| 2012/0026492 | A1 | 2/2012 | Zhang | |
| 2012/0034845 | A1 | 2/2012 | Hu | |
| 2012/0276662 | A1 | 11/2012 | Iravani et al. | |
| 2013/0045546 | A1 | 2/2013 | Schlicker | |
| 2015/0371913 | A1 | 12/2015 | Lu et al. | |
| 2017/0365532 | A1 | 12/2017 | Lu et al. | |

FOREIGN PATENT DOCUMENTS

| | | |
|---|---|---|
| TW | 200936312 | 9/2009 |
| TW | 201230224 | 7/2012 |
| TW | 201422369 | 6/2014 |
| WO | WO 2012/015694 | 2/2012 |

OTHER PUBLICATIONS

International Search Report and Written Opinion in International Application No. PCT/US2015/036520, dated Aug. 31, 2015, 8 pages.

International Search Report and Written Opinion in International Application No. PCT/US2017/051396, dated Dec. 27, 2017, 13 pages.

* cited by examiner

OVERPOLISHING BASED ON ELECTROMAGNETIC INDUCTIVE MONITORING OF TRENCH DEPTH

CROSS-REFERENCE TO RELATED APPLICATIONS

This application claims priority to U.S. Provisional Application Ser. No. 62/395,969, filed Sep. 16, 2016, and to U.S. Provisional Application Ser. No. 62/464,269, filed on Feb. 27, 2017, the entire disclosures of which are incorporated by reference.

TECHNICAL FIELD

The present disclosure relates to monitoring using electromagnetic induction, e.g., eddy current monitoring, during chemical mechanical polishing.

BACKGROUND

An integrated circuit is typically formed on a substrate (e.g. a semiconductor wafer) by the sequential deposition of conductive, semiconductive or insulative layers on a silicon wafer, and by the subsequent processing of the layers.

One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization may be used to planarize a dielectric layer for lithography.

Chemical mechanical polishing (CMP) is one accepted method of planarization. This planarization method typically requires that the substrate be mounted on a carrier head. The exposed surface of the substrate is placed against a rotating polishing pad. The carrier head provides a controllable load on the substrate to push it against the polishing pad. A polishing liquid, such as slurry with abrasive particles, is supplied to the surface of the polishing pad.

During semiconductor processing, it may be important to determine one or more characteristics of the substrate or layers on the substrate. For example, it may be important to know the thickness of a conductive layer during a CMP process, so that the process may be terminated at the correct time. A number of methods may be used to determine substrate characteristics. For example, optical sensors may be used for in-situ monitoring of a substrate during chemical mechanical polishing. Alternately (or in addition), an eddy current sensing system may be used to induce eddy currents in a conductive region on the substrate to determine parameters such as the local thickness of the conductive region.

SUMMARY

In one aspect, a polishing system includes a platen to hold a polishing pad, a carrier head to hold a substrate against the polishing pad during polishing, a first in-situ monitoring system, a second in-situ monitoring system, and a controller. The first in-situ monitoring system has a first sensor to monitor the substrate during polishing and is configured to generate a first signal that depends on clearing of a conductive layer and exposure of a top surface of underlying dielectric layer of the substrate. The second in-situ monitoring system has a separate second sensor to monitor the substrate during polishing and is configured to generate a second signal that depends on a thickness of conductive material in trenches in the dielectric layer. The second in-situ monitoring system is an electromagnetic induction monitoring system. The controller is configured to receive the first signal from the first in-situ monitoring system and determine a clearance time at which the conductive layer is cleared based on the first signal, receive the second signal and determine an initial value of the second signal at the determined clearance time, add an offset to the initial value to generate a threshold value, and trigger a polishing endpoint when the second signal crosses the threshold value.

In another aspect, a computer program product is a non-transitory computer-readable medium having instructions to cause a processor to receive during polishing of a substrate a first signal from a first in-situ monitoring system and determine based on the first signal a clearance time at which a conductive layer is cleared and a top surface of an underlying dielectric layer of the substrate exposed, receive during polishing of the substrate a second signal from a second in-situ monitoring system and determine an initial value of the second signal at the determined clearance time, add an offset to the initial value to generate a threshold value, and trigger a polishing endpoint when the second signal crosses the threshold value.

Implementations of any aspect may include one or more of the following features.

The second in-situ monitoring system may be configured to induce current in conductive loops disposed in the dielectric layer.

The first in-situ monitoring system may be an optical monitoring system, an eddy current monitoring system, a friction monitoring system, or a motor torque or motor current monitoring system.

The first sensor and the second sensor may be positioned in separate recesses in the platen. The first sensor and the second sensor may be configured to simultaneously measure a same location on the substrate.

The controller may be configured to receive a desired amount of overpolishing as input from a user. The controller may be configured to calculate the threshold value VT as $VT=V0-kD$, where V is the initial value, D is the desired amount of overpolishing, and k is a constant.

Certain implementations can include one or more of the following advantages. Metal residue can be reduced, increasing yield. Polishing can be halted more reliably at a target amount removal of material from trenches (e.g., dishing), and water-to-wafer non-uniformity (WTWNU) can be reduced.

The details of one or more implementations are set forth in the accompanying drawings and the description below. Other aspects, features and advantages will be apparent from the description and drawings, and from the claims.

BRIEF DESCRIPTION OF DRAWINGS

Like reference symbols in the various drawings indicate like elements.

DETAILED DESCRIPTION

For chemical mechanical polishing of conductive layers, e.g., metal polishing, overpolishing is important to prevent metal residue and thus guarantee good electrical yield. However, excessive overpolishing can cause dishing and erosion that will deteriorate electrical performance.

Conventionally, overpolishing is controlled by time. For example, endpoint can triggered by detection of clearance of an underlying layer using an in-situ monitoring system, and overpolishing then proceed for a predetermined amount time following the detection of the polishing endpoint, at which point polishing is halted. The overpolish time can be preselected to be sufficiently large to ensure no metal residue. However, this carries the risk of excessive overpolishing, e.g., dishing and erosion as noted above.

Another technique to control overpolishing is by "percentage." In this case, the overpolishing time is calculated as a percentage of total time from the start of polishing to the triggering of endpoint. However, variations in incoming thickness can mislead the calculation of overpolish time, resulting in inconsistent performance.

A CMP system can use two in-situ monitoring systems. The first in-situ monitoring system, e.g., an optical or eddy current monitoring system, is configured to detect clearance of the conductive layer and exposure of the underlying layer. The second in-situ monitoring system is configured to generate a signal that depends on trench depth, and can be used to halt polishing when the trench reaches a target depth.

Figure 1:
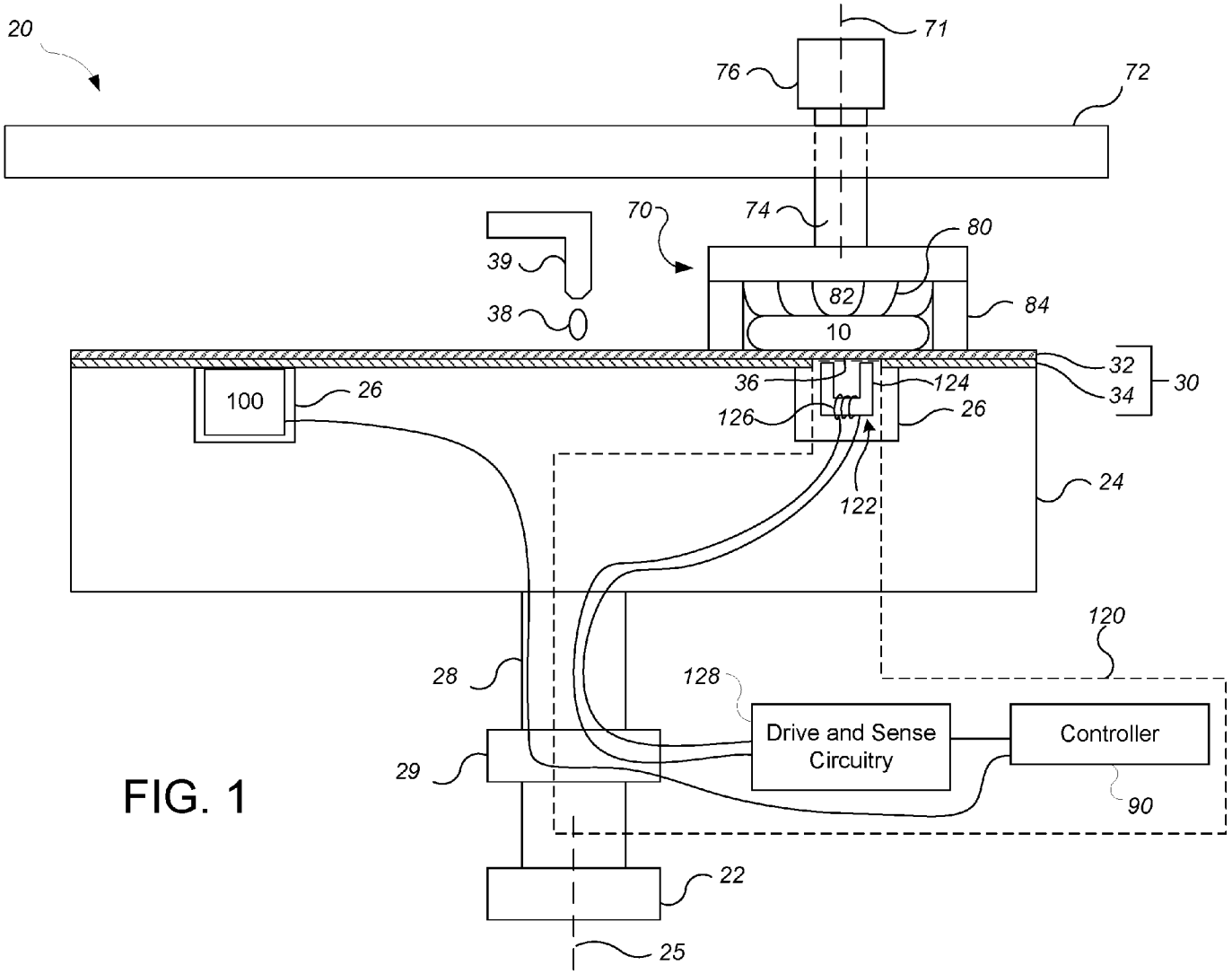
FIG. 1 is a schematic side view, partially cross-sectional, of a chemical mechanical polishing station that includes an electromagnetic induction monitoring system.
Figure 2:
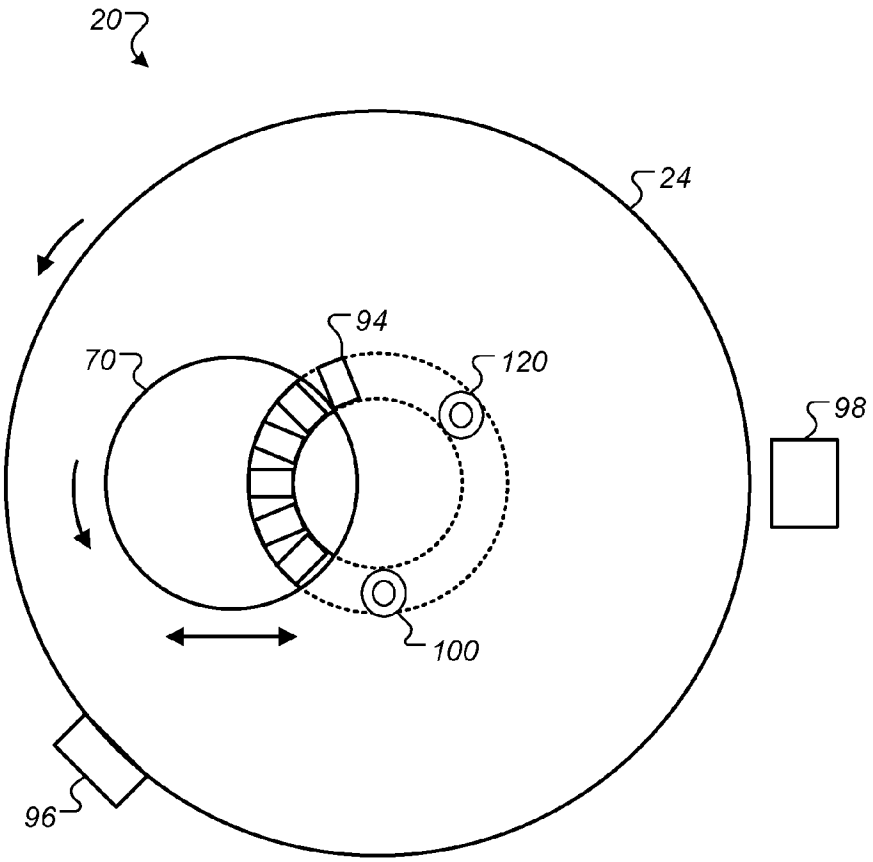
FIG. 2 is a schematic top view of the chemical mechanical polishing station of FIG. 1.

FIGS. 1 and 2 illustrate an example of a polishing station 20 of a chemical mechanical polishing apparatus. The polishing station 20 includes a rotatable disk-shaped platen 24 on which a polishing pad 30 is situated. The platen 24 is operable to rotate about an axis 25. For example, a motor 22 can turn a drive shaft 28 to rotate the platen 24. The polishing pad 30 can be a two-layer polishing pad with an outer layer 34 and a softer backing layer 32.

The polishing station 22 can include a supply port or a combined supply-rinse arm 39 to dispense a polishing liquid 38, such as slurry, onto the polishing pad 30. The polishing station 22 can include a pad conditioner apparatus with a conditioning disk to maintain the condition of the polishing pad.

The carrier head 70 is operable to hold a substrate 10 against the polishing pad 30. The carrier head 70 is suspended from a support structure 72, e.g., a carousel or a track, and is connected by a drive shaft 74 to a carrier head rotation motor 76 so that the carrier head can rotate about an axis 71. Optionally, the carrier head 70 can oscillate laterally, e.g., on sliders on the carousel or track 72; or by rotational oscillation of the carousel itself.

In operation, the platen is rotated about its central axis 25, and the carrier head is rotated about its central axis 71 and translated laterally across the top surface of the polishing pad 30. Where there are multiple carrier heads, each carrier head 70 can have independent control of its polishing parameters, for example each carrier head can independently control the pressure applied to each respective substrate.

The carrier head 70 can include a flexible membrane 80 having a substrate mounting surface to contact the back side of the substrate 10, and a plurality of pressurizable chambers 82 to apply different pressures to different zones, e.g., different radial zones, on the substrate 10. The carrier head can also include a retaining ring 84 to hold the substrate.

One or more recesses 26 are formed in the platen 24, and optionally one or more thin sections 36 can be formed in the polishing pad 30 overlying one or more recesses 26. Each recess 26 and thin pad section 36 can be positioned such that regardless of the translational position of the carrier head they pass beneath substrate 10 during a portion of the platen rotation. Assuming that the polishing pad 30 is a two-layer pad, the thin pad section 36 can be constructed by removing a portion of the backing layer 32. One or more of the thin sections can optionally be optically transmissive, e.g., if an in-situ optical monitoring system is integrated into the platen 24.

Figure 4:
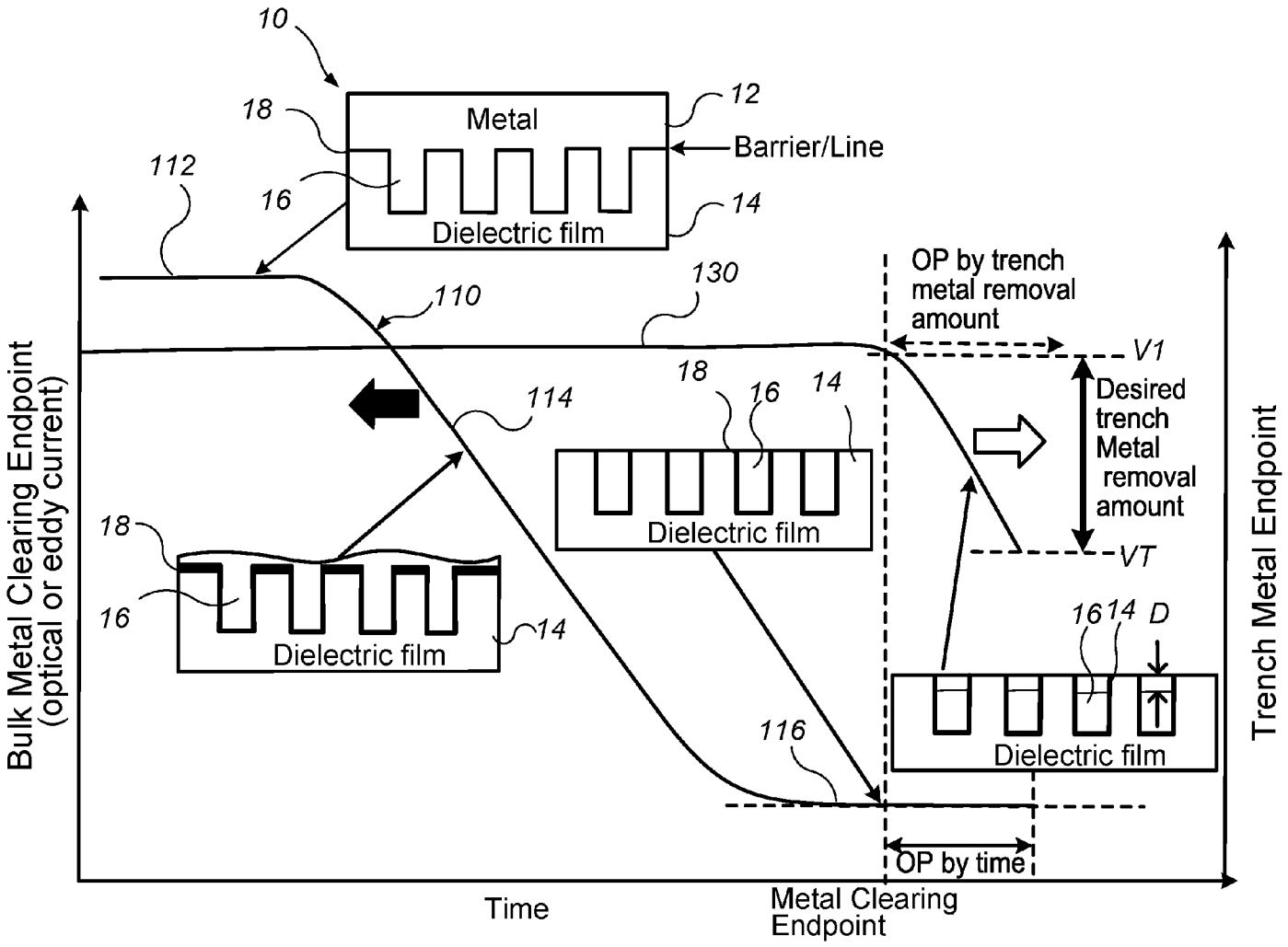
FIG. 4 is a shows exemplary graphs illustrating a signals from two in-situ monitoring systems and schematic cross-sectional views of the substrate at different stages of polishing.

Referring to FIG. 4, the polishing system 20 can be used to polish a substrate 10 that includes a conductive layer overlying a patterned dielectric layer. For example, the substrate 10 can include a conductive layer 12, e.g., a metal, e.g, copper, aluminum, cobalt or titanium, that overlies and fills trenches 16 in a dielectric layer 14, e.g., silicon oxide or a high-k dielectric. Optionally a barrier layer 18, e.g., tantalum or tantalum nitride, can line the trenches and separate the conductive layer 12 from the dielectric layer 14. The trenches 16 can provide vias, pads and/or interconnects in a completed integrated circuit.

Returning to FIG. 1, the polishing system 20 includes a first in-situ monitoring system 100 and a second in-situ monitoring system 120, both of which can be coupled to or be considered to include a controller 90.

Each in-situ monitoring system can include a sensor positioned in one of the recesses 26 in the platen 24. Each sensor can sweep underneath the substrate with each rotation of the platen. Although FIG. 1 illustrates the sensors of the in-situ monitoring systems 100, 120 as positioned in different recesses, they could be placed in the same recesses 26. The in-situ monitoring system 100, 120 could also be configured to simultaneously monitor the same location on the substrate 10 as the recess 26 passes below the substrate 10. A rotary coupler 29 can be used to electrically connect components in the rotatable platen 24, e.g., the sensors of the in-situ monitoring systems, to components outside the platen, e.g., drive and sense circuitry or the controller 90.

The first in-situ monitoring system 100 is configured to detect clearance of the conductive layer 12 and exposure of an underlying layer. For example, the first in-situ monitoring system 100 can be configured to detect exposure of the dielectric layer 14.

The first in-situ monitoring system 100 can be an optical monitoring system, e.g., a spectrographic system that is configured to detect a change in spectra of reflected light upon exposure of the underlying layer. Alternatively, the first monitoring system 100 can be an intensity monitoring system, e.g., a monochromatic light monitoring system, that is configured to detect a sudden change in intensity of reflected light upon exposure of the underlying layer. For example, the dielectric layer is typically much less reflective than the metal layer, and therefore a sudden drop in reflected light intensity can indicate exposure of the underlying layer.

As another example, the first in-situ monitoring system can be an eddy current monitoring system 100 that is tuned to monitor polishing of the conductive layer while the conductive layer remains as a generally intact sheet over the dielectric layer, e.g., as described in U.S. Patent Publication No. 2012-0276661. As another example, the first in-situ monitoring system can be a friction monitoring system, e.g., as described in U.S. Patent Publication No. 2005-0136800, or a motor torque or motor current monitoring system, e.g., as described in U.S. Patent Publication No. 2013-0288572. In these cases, the exposure of the underlying layer can result in a change of coefficient of friction between the substrate and the polishing pad, which can result in a change in friction, motor torque or motor current, which can be detected.

The second in-situ monitoring system 120 is configured to generate a signal that depends on the depth of the conductive material 12, e.g., the metal, in the trenches 16. In particular, the in-situ monitoring system 120 can be an electromagnetic induction monitoring system. The electromagnetic induction monitoring system can operate either by generation of eddy-currents in the conductive material in the trenches, or generation of current in a conductive loop formed in a trench in the dielectric layer on the substrate. In operation, the polishing system 20 uses the second in-situ monitoring system 120 to determine when the trench depth has reached as a target depth, and then halts polishing.

The second monitoring system 120 can include a sensor 122 installed in a recess 26 in the platen 24. The sensor 122 can include a magnetic core 124 positioned at least partially in the recess 26, and at least one coil 126 wound around the core 124. Drive and sense circuitry 128 is electrically connected to the coil 126. The drive and sense circuitry 128 generates a signal that can be sent to the controller 90. Although illustrated as outside the platen 24, some or all of the drive and sense circuitry 128 can be installed in the platen 24.

As the platen 24 rotates, the sensor 122 sweeps below the substrate 10. By sampling the signal from the circuitry 128 at a particular frequency, the circuitry 128 generates measurements at a sequence of sampling zones across the substrate 10. For each sweep, measurements at one or more of the sampling zones 94 can be selected or combined. Thus, over multiple sweeps, the selected or combined measurements provide the time-varying sequence of values.

The polishing station 20 can also include a position sensor 96 (see FIG. 2), such as an optical interrupter, to sense when the sensor 122 is underneath the substrate 10 and when the sensor 122 is off the substrate. For example, the position sensor 96 can be mounted at a fixed location opposite the carrier head 70. A flag 98 (see FIG. 2) can be attached to the periphery of the platen 24. The point of attachment and length of the flag 98 is selected so that it can signal the position sensor 96 when the sensor 122 sweeps underneath the substrate 10. The position sensor 96 can also be used to determine when the sensor of the first in-situ monitoring system 100 is underneath the substrate.

Alternately, the polishing station 20 can include an encoder to determine the angular position of the platen 24.

A controller 90, e.g., a general purpose programmable digital computer, receives the signals from the second electromagnetic induction monitoring system 120. Since each sensor 122 sweeps beneath the substrate 10 with each rotation of the platen 24, information on the depth of the trenches is accumulated in-situ (once per platen rotation). The controller 90 can be programmed to sample measurements from the second in-situ monitoring system 120 when the substrate 10 generally overlies the sensor 122.

In addition, the controller 90 can be programmed to divide the measurements, from both the first in-situ monitoring system 100 and the electromagnetic induction current monitoring system 120, from each sweep beneath the substrate into a plurality of sampling zones, to calculate the radial position of each sampling zone, and to sort the measurements into radial ranges.

Figure 3:
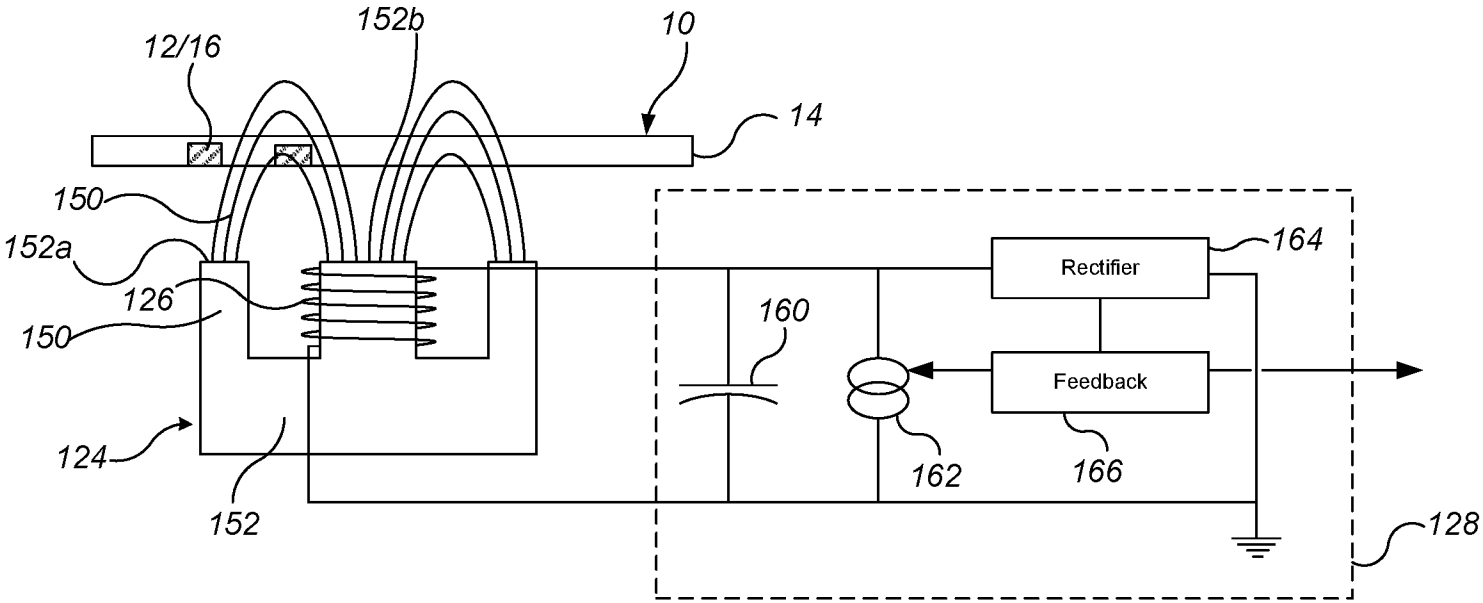
FIG. 3 is a schematic circuit diagram of a drive system for an electromagnetic induction monitoring system.

FIG. 3 illustrates an example of the drive and sense circuitry 128. The circuitry 128 applies an AC current to the coil 128, which generates a magnetic field 150 between two poles 152*a* and 152*b* of the core 124. The core 124 can include two (see FIG. 1) or three (see FIG. 3) prongs 150 extending in parallel from a back portion 152. Implementations with only one prong (and no back portion) are also possible. In operation, when the substrate 10 intermittently overlies the sensor 122, a portion of the magnetic field 150 extends into the substrate 10.

The circuitry 128 can include a capacitor 160 connected in parallel with the coil 126. Together the coil 126 and the capacitor 160 can form an LC resonant tank. In operation, a current generator 162 (e.g., a current generator based on a marginal oscillator circuit) drives the system at the resonant frequency of the LC tank circuit formed by the coil 126 (with inductance L) and the capacitor 160 (with capacitance C). The current generator 162 can be designed to maintain the peak to peak amplitude of the sinusoidal oscillation at a constant value. A time-dependent voltage with amplitude $V_0$ is rectified using a rectifier 164 and provided to a feedback circuit 166. The feedback circuit 166 determines a drive current for current generator 162 to keep the amplitude of the voltage $V_0$ constant. Marginal oscillator circuits and feedback circuits are further described in U.S. Pat. Nos. 4,000,458, and 7,112,960.

As an eddy current monitoring system, the electromagnetic induction monitoring system 120 can be used to monitor the thickness of the conductive trenches by inducing eddy currents in the conductive material in the trenches. Alternatively, the electromagnetic induction monitoring system can operate by generating a current in a conductive loop formed in the dielectric layer 14 of the substrate 10 for the purpose of monitoring, e.g., as described in U.S. Patent Publication No. 2015-0371907, which is incorporated by reference in its entirety.

If monitoring of the thickness of a conductive layer on the substrate is desired, then when the magnetic field 150 reaches the conductive layer, the magnetic field 150 can pass through and generate a current (if the target is a loop) or create an eddy-current (if the target is a sheet). This creates an effective impedance, thus increasing the drive current required for the current generator 162 to keep the amplitude of the voltage V0 constant. The magnitude of the effective impedance depends on the thickness of the conductive layer. Thus, the drive current generated by the current generator 162 provides a measurement of the thickness of the conductive layer being polished.

Other configurations are possible for the drive and sense circuitry 128. For example, separate drive and sense coils could be wound around the core, the drive coil could be driven at a constant frequency, and the amplitude or phase (relative to the driving oscillator) of the current from the sense coil could be used for the signal.

Referring to FIG. 4, prior to polishing, the bulk of the conductive layer 12 is initially relatively thick and continuous. If the first in-situ monitoring system 100 is an eddy current monitoring system, then because the layer 12 has a low resistivity, relatively strong eddy currents can be generated in the conductive layer. As a result a signal 110 from the first in-situ monitoring system 100 can start at an initial value shown by portion 112 of the signal 110.

As the substrate 10 is polished the bulk portion of the conductive layer 12 is thinned. When the conductive layer 12 becomes thin enough, or as the underlying dielectric layer is exposed, the signal 110 changes, e.g., falls, in region 114. For example, for an eddy current monitoring system, as the conductive layer 12 thins, its sheet resistivity increases, and the coupling between the conductive layer 12 and sensor circuitry is reduced.

Eventually the bulk portion of the conductive layer 12 is removed, exposing the top surface of the dielectric layer 14 and leaving conductive interconnects 16 in the trenches between the patterned dielectric layer 14. At this point, the signal 110, whether optical, eddy current or friction based, will tend to stabilize, as shown in portion 116 of the signal 110. This causes a noticeable decrease in the rate of change in amplitude of the output signal 110. Either the sudden change in slope of the signal 110, or the slope of the signal 110 falling below a threshold, can be detected by the first in-situ monitoring system 100, e.g., by the controller 90, to detect a clearance of the conductive layer. This time can be called a metal clearing endpoint.

Detection of the metal clearing endpoint triggers reliance on the second in-situ monitoring system 120. In particular, the controller can capture the value $V_0$of the signal 130 from the second in-situ monitoring system at the time that the first in-situ monitoring system 100 detects the metal clearing endpoint. Based on the desired amount of overpolishing, a threshold value $V_T$ can be calculated. For example, a threshold can be calculated as $V_T=V_0-kD$, where D is the desired amount of overpolishing (e.g., a thickness amount, e.g., in Angstroms) and k is an empirically determined constant. The value of D can be received as user input before polishing of the substrate 10 from the operator of the polishing system 20, e.g., through a graphical user interface.

The second in-situ monitoring system 120 continues to monitors the substrate, and halts polishing when the signal 130 crosses the threshold value $V_T$. As a result, the overpolish time is controlled based on a desired trench metal removal amount by the second in-situ monitoring system, and can be consistent from wafer-to-wafer.

The dual in-situ monitoring systems 100, 120 can be used in a variety of polishing systems. Either the polishing pad, or the carrier head, or both can move to provide relative motion between the polishing surface and the substrate. The polishing pad can be a circular (or some other shape) pad secured to the platen, a tape extending between supply and take-up rollers, or a continuous belt. The polishing pad can be affixed on a platen, incrementally advanced over a platen between polishing operations, or driven continuously over the platen during polishing. The pad can be secured to the platen during polishing, or there can be a fluid bearing between the platen and polishing pad during polishing. The polishing pad can be a standard (e.g., polyurethane with or without fillers) rough pad, a soft pad, or a fixed-abrasive pad.

A number of embodiments have been described. Nevertheless, it will be understood that various modifications may be made without departing from the spirit and scope of the disclosure. Accordingly, other embodiments are within the scope of the following claims.

What is claimed is:

1. A polishing system, comprising:

a platen to hold a polishing pad;

a carrier head to hold a substrate against the polishing pad during polishing;

a first in-situ monitoring system having a first sensor to monitor the substrate during polishing and configured to generate a first signal that depends on clearing of a conductive layer and exposure of a top surface of underlying dielectric layer of the substrate;

a second in-situ monitoring system having a separate second sensor to monitor the substrate during polishing and configured to generate a second signal that depends on a thickness of conductive material in trenches in the dielectric layer, the second in-situ monitoring system being an electromagnetic induction monitoring system; and a controller configured to receive the first signal from the first in-situ monitoring system and determine a clearance time at which the conductive layer is cleared based on the first signal, receive the second signal and determine an initial value of the second signal at the determined clearance time, add an offset to the initial value to generate a threshold value, and trigger a polishing endpoint when the second signal crosses the threshold value.

2. The polishing system of claim 1, wherein the second in-situ monitoring system is configured to induce current in conductive loops disposed in the dielectric layer.

3. The polishing system of claim 1, wherein the first in-situ monitoring system comprises an optical monitoring system, an eddy current monitoring system, a friction monitoring system, or a motor torque or motor current monitoring system.

4. The polishing system of claim 3, wherein the first in-situ monitoring system comprises an eddy current monitoring system tuned to monitor the conductive layer while the conductive layer is an intact sheet on the dielectric layer.

5. The polishing system of claim 1, wherein the first sensor and the second sensor are positioned in separate recesses in the platen.

6. The polishing system of claim 1, wherein the first sensor and the second sensor ae positioned in a same recess in the platen.

7. The polishing system of claim 1, wherein the first sensor and the second sensor are configured to simultaneously measure a same location on the substrate.

8. The polishing system of claim 1, wherein the first sensor and the second sensor are spaced apart to simultaneously measure different locations on the substrate.

9. The polishing system of claim 1, wherein the controller is configured to receive a desired amount of overpolishing as input from a user.

10. The polishing system of claim 9, wherein the controller is configured to calculate the threshold value VT as VT=V0−kD, where V0 is the initial value, D is the desired amount of overpolishing, and k is a constant.

11. A computer program product, comprising a non-transitory computer-readable medium having instructions to cause a processor to:

receive during polishing of a substrate a first signal from a first in-situ monitoring system and determine based on the first signal a clearance time at which a conductive layer is cleared and a top surface of an underlying dielectric layer of the substrate exposed;

receive during polishing of the substrate a second signal from a second in-situ monitoring system and determine an initial value of the second signal at the determined clearance time;

add an offset to the initial value to generate a threshold value; and trigger a polishing endpoint when the second signal crosses the threshold value.

12. The computer program product of claim 11, comprising instructions to receive a desired amount of overpolishing as input from a user.

13. The computer program product of claim 12, comprising instructions to calculate the threshold value VT as VT=V0−kD, where V0 is the initial value, D is the desired amount of overpolishing, and k is a constant.

14. A method of controlling a polishing operation, comprising:

monitoring a substrate during polishing of the substrate with a first in-situ monitoring system and determining based on a first signal from the first in-situ monitoring system a clearance time at which a conductive layer is cleared and a top surface of an underlying dielectric layer of the substrate exposed;

monitoring the substrate during polishing of the substrate with a second in-situ monitoring system and determining an initial value of a second signal from the second in-situ monitoring system at the determined clearance time;

adding an offset to the initial value to generate a threshold value; and triggering a polishing endpoint when the second signal crosses the threshold value.

15. The method of claim 14, wherein monitoring the substrate with the second in-situ monitoring system comprises inducing current in conductive loops disposed in the dielectric layer.

16. The method of claim 14, wherein the first in-situ monitoring system comprises an optical monitoring system, an eddy current monitoring system, a friction monitoring system, or a motor torque or motor current monitoring system.

17. The method of claim 16, wherein the first in-situ monitoring system comprises an eddy current monitoring system tuned to monitor the conductive layer while the conductive layer is an intact sheet on the dielectric layer.

18. The method of claim 14, comprising receiving a desired amount of overpolishing as input from a user.

19. The method of claim 18, comprising calculating the threshold value VT as VT=V0−kD, where V0 is the initial value, D is the desired amount of overpolishing, and k is a constant.

20. The method of claim 14, wherein determining the clearance time comprises detecting a change in slope of the first signal or detecting that the slope of the first signal has fallen below a threshold.

* * * * *